US010906262B2

(12) United States Patent
Gröbl et al.

(10) Patent No.: US 10,906,262 B2
(45) Date of Patent: Feb. 2, 2021

(54) METHOD FOR CONTROLLING A CERAMIC OR METAL POWDER PRESS, AND CERAMIC OR METAL POWDER PRESS

(71) Applicant: DORST Technologies GmbH & Co. KG, Kochel am See (DE)

(72) Inventors: Herbert Ludwig Gröbl, Murnau (DE); Roland Menzel, Kochel am See (DE)

(73) Assignee: Dorst Technologies GMBH & Co. KG, Kochel am See (DE)

( * ) Notice: Subject to any disclaimer, the term of this patent is extended or adjusted under 35 U.S.C. 154(b) by 1006 days.

(21) Appl. No.: 14/431,417

(22) PCT Filed: Sep. 30, 2013

(86) PCT No.: PCT/DE2013/100346
§ 371 (c)(1),
(2) Date: Jul. 14, 2015

(87) PCT Pub. No.: WO2014/053120
PCT Pub. Date: Apr. 10, 2014

(65) Prior Publication Data

US 2015/0314547 A1 Nov. 5, 2015

(30) Foreign Application Priority Data

Oct. 1, 2012 (DE) ..... 10 2012 019 312

(51) Int. Cl.

| | |
|---|---|
| ***B30B 11/00*** | (2006.01) |
| ***B22F 3/00*** | (2006.01) |
| ***B22F 3/02*** | (2006.01) |
| ***B28B 3/02*** | (2006.01) |
| ***B28B 17/00*** | (2006.01) |
| ***B30B 15/00*** | (2006.01) |

(52) U.S. Cl.
CPC ..... *B30B 11/005* (2013.01); *B22F 3/003* (2013.01); *B22F 3/02* (2013.01); *B28B 3/02* (2013.01); *B28B 17/0081* (2013.01); *B30B 15/007* (2013.01)

(58) Field of Classification Search
CPC ..... B30B 11/005; B30B 15/0029; B30B 15/0035; B30B 15/0041; B30B 15/0094; B30B 15/26; B28B 17/0081; B28B 3/083
See application file for complete search history.

(56) References Cited

U.S. PATENT DOCUMENTS

| | | | | |
|---|---|---|---|---|
| 4,447,198 | A | 5/1984 | Long et al. | |
| 5,087,398 | A * | 2/1992 | Le Molaire | B30B 11/005 264/109 |
| 6,074,584 | A * | 6/2000 | Hinzpeter | B22F 3/03 264/109 |
| 6,562,291 | B2 * | 5/2003 | Hinzpeter | B22F 3/02 419/14 |
| 7,018,194 | B2 * | 3/2006 | Kitamura | B30B 15/0017 425/193 |
| 7,351,048 | B2 * | 4/2008 | Hinzpeter | B22F 3/03 425/149 |

FOREIGN PATENT DOCUMENTS

| | | | |
|---|---|---|---|
| DE | 10 2009 004620 | A1 | 7/2010 |
| DE | 10 2010 033998 | A1 | 2/2012 |
| DE | 102010051513 | A1 | 5/2012 |
| EP | 2311587 | A1 | 4/2011 |
| EP | 2 361 758 | A2 | 8/2011 |
| JP | S57-209797 | A | 12/1982 |
| JP | 2004-141916 | | 5/2004 |
| JP | 2008-266752 | | 11/2008 |
| WO | WO 03/091012 | A1 | 11/2003 |
| WO | WO 2008/104969 | A1 | 9/2008 |

OTHER PUBLICATIONS

Office Action dated May 24, 2016 in Chinese Application No. 201380062811.8.
International Search Report dated Feb. 17, 2014 for International Application No. PCT/DE2013/100346 filed Sep. 30, 2013, 7 pages.
Examination Report for European Application No. 13798548.7 dated Jul. 12, 2018.
Priority Search Report to German Application No. 2012019312.2 dated Jun. 19, 2013.

* cited by examiner

*Primary Examiner* — Gregory D Swiatocha
(74) *Attorney, Agent, or Firm* — Knobbe Martens Olson & Bear LLP

(57) ABSTRACT

The invention relates to a method of controlling a ceramic and/or metal powder press (1) for pressing a compressible material (6), wherein at least one electromotive drive (15, 16; 20, 21), which adjusts
at least one punch (5; 4) along a pressing direction, is controlled in such a manner that the drive (15, 16; 20, 21) moves the punch (5; 4) along a setpoint positioning path (as1) and the drive is readjusted if it deviates from the setpoint positioning path (as1), wherein a measured force (F11, F12) acting on the compressible material (6), the punch (4) or its supporting components (17-19), is used as at least one control variable for readjustment. The invention also relates to a ceramic and/or metal powder press (1) configured to carry out the method.

17 Claims, 1 Drawing Sheet

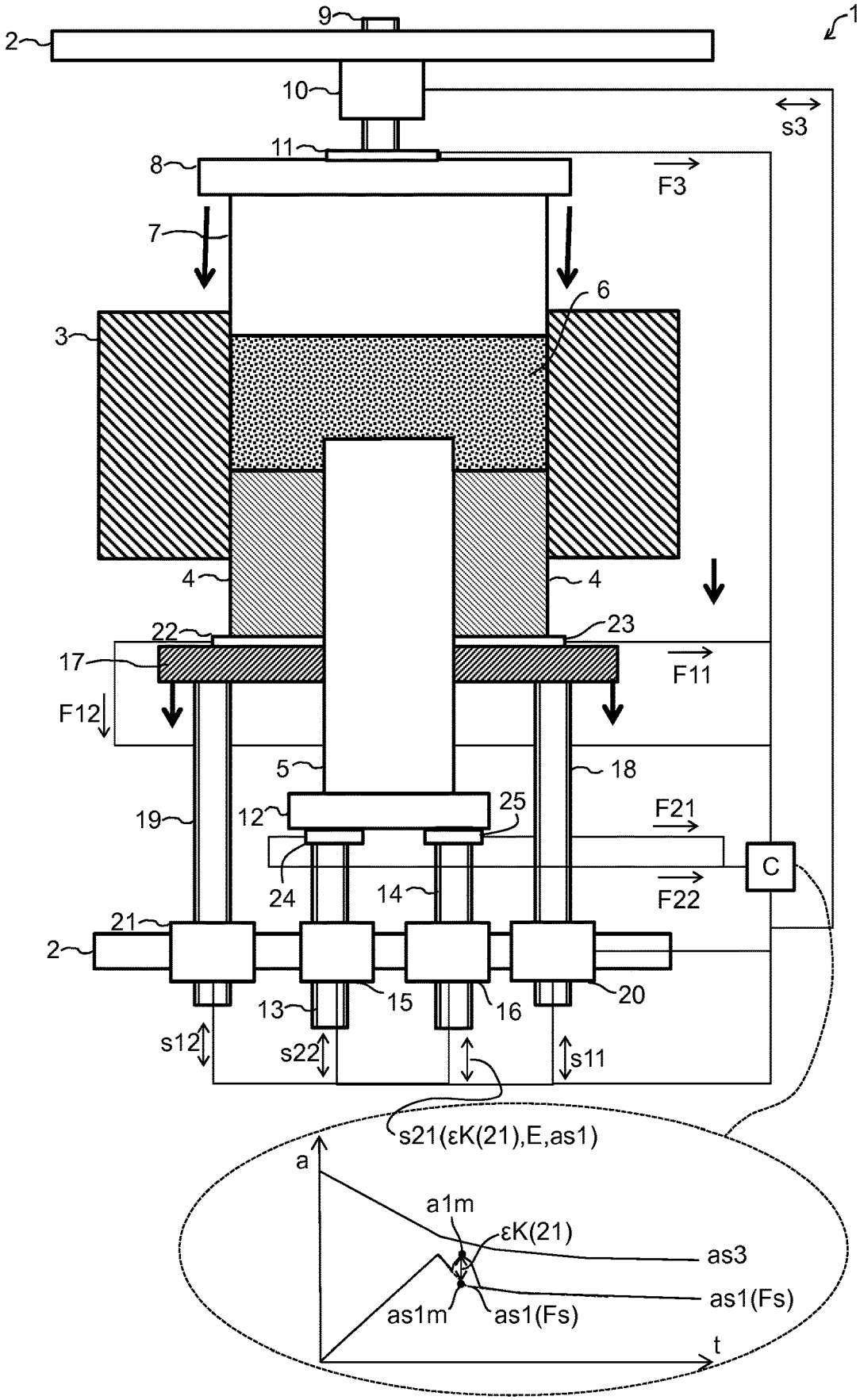
1
2
9
10
11
8
s3
F3
7
6
3
4
4
22
23
17
F11
F12
5
18
19
12
25
F21
24
14
C
F22
21
2
13
15
16
20
s12
s22
s11
s21(εK(21),E,as1)
a
a1m
εK(21)
as3
as1(Fs)
as1m
as1(Fs)
t

METHOD FOR CONTROLLING A CERAMIC OR METAL POWDER PRESS, AND CERAMIC OR METAL POWDER PRESS

CROSS-REFERENCE TO RELATED APPLICATIONS

This application is a U.S. National Phase under 35 U.S.C. § 371 of International Application No. PCT/DE2013/100346, filed Sep. 30, 2013, which claims priority to German Application Number 10 2012 019 312.2, filed Oct. 1, 2012 in the German Patent Office.

BACKGROUND

Technological Field

The present invention relates to a method for controlling a ceramic and/or metal powder press for pressing a compressible material, wherein at least one electromotive drive, which adjusts at least one punch along a pressing direction, is controlled in such a manner that the drive moves the punch along a setpoint positioning path to each momentary setpoint position of the punch, and the drive is readjusted if it deviates from the setpoint positioning path. The invention also relates to a ceramic and/or metal powder press for pressing a compressible material controlled in such a manner.

Description of the Related Technology

Ceramic and/or metal powder presses are known where so-called floating of individual axes, i.e. in particular of the punch and its supporting components, is required during the shaping process of a pressing method. The term floating means that the axis can be displaced from its position by at least one other axis, in particular an opposing axis. However, it resists the displacement force exerted by the other axis with a force programmed for this axis in the tool program, which, for illustrative purposes, is comparable to a spring action. A further case of application is in a force-controlled reduction in the pressing force, in particular at the top force-exerting axis. The term floating can therefore also be described as yielding or readjusting in a controlled manner.

With servo-motive powder presses, in particular, especially multi-plate presses, there is a particular problem in the case of spindle presses, which have a spindle drive, compared to hydraulic powder presses, for example. Classic torque limitation provided in spindle drives by means of a drive control, open-loop or closed-loop, as an operating function of the servo controller, is not able to limit the force applied to such axes in an absolutely precise manner. The reason for this is that the rotary movement of the servo motor is transformed into a translatory movement with the aid of a spindle. The efficiency of this spindle depends on a plurality of physical quantities, including the temperature, and must therefore be regarded as a quasi-unknown quantity. If a dual drive is used for such a tool axis, torque limitation is useless. In a dual drive, two servo motors each having a spindle, drive a tool axis. Due to the efficiency problem of the spindles, synchronous driving of the two servo axes cannot be guaranteed. From the point of view of process engineering, the tolerance for the synchronicity deviation is less than 0.01 mm, in particular.

Servo controllers usable in such spindle presses consist of electric current, speed and position controllers. With these controllers, force control is basically not possible.

SUMMARY

It is the object of the present invention to improve a ceramic and/or metal powder press and a method of controlling a ceramic and/or metal powder press for pressing a compressible material by using at least one electromotive drive in such a way that more reliable operation, in particular force control on at least one floating axis, or a floating punch, is possible. In particular, the method is to be applicable with presses provided with a servo spindle drive.

The object is achieved by a method of controlling a ceramic and/or metal powder press for pressing a compressible material, wherein at least one electromotive drive, which adjusts at least one punch along a pressing direction, is controlled in such a manner that the drive moves the punch along a setpoint positioning path, and the drive is readjusted if it deviates from the setpoint positioning path, characterized in that a measured force acting on the compressible material, the punch or its supporting components, is used as at least one control variable for readjustment. The object is also achieved by a ceramic and/or metal powder press comprising at least one electromotive drive, which adjusts at least one punch along a pressing direction; one controller, which is adapted to control the drive in such a manner that the drive moves the punch along a setpoint positioning path of the punch, and the drive readjusts if it deviates from the setpoint positioning path; and at least one force-measuring device, which is arranged for measuring a pressing force acting on the compressible material, the punch or its supporting components, wherein the measured force is at least one control variable for the controller for readjustment. Advantageous embodiments are described throughout this application.

A particularly preferred embodiment provides a method of controlling a ceramic and/or metal powder press for pressing a compressible material, wherein at least one electromotive drive, which adjusts at least one punch along the pressing direction, is controlled in such a manner that the drive moves the punch along a setpoint positioning path, in particular to each momentary setpoint position of the punch and the drive is readjusted if it deviates from the setpoint positioning path, wherein a measured force acting on the compressible material, the punch or its supporting components is used as at least one control variable for readjustment.

In other words, control of setpoint positions of at least the one punch is achieved via its at least one electromotive drive as a function of a measured force. Control can also be realized by means of readjustment using various interconnected open-loop and closed-loop control and regulating devices.

The force of the tool axis, that is, in particular, the measured force acting on one of the components in the range extending from the punch to its point of fixing relative to a frame and relative to further tool axes, as the case may be, is measured by means of suitable sensors, or a suitable force-measuring device, in the translatory movement during a running process cycle.

Such control is implementable for only one punch of a plurality of punches of such a press, or a corresponding tool used in such a press. Such control can also be implemented, however, for a plurality, or all, punches of such a press, or such a tool.

A further embodiment provides that the readjustment is carried out with respect to the setpoint positioning path as a function of the at least one measured force wherein, according to a further development, the setpoint positioning path is predefined as a function of a setpoint force, in particular.

Again, force values are transposed into position values. A further development is that each axis evaluates the applicable force for itself independently of the overall combination, and can initiate readjustment.

A further embodiment provides calculating and/or controlling setpoint positions of at least one punch as a function of at least one such measured force.

A further embodiment provides that the setpoint positioning path, in particular of a servo axis or a plurality of servo axes, is calculated as a function of the measured force, in particular calculated in such a manner that a tool axis, or its punch, in particular, follows the programmed force.

By these means, in particular, the position is not controlled via a direct control variable of a drive, for example a voltage applied to the drive, an applied current or an oil pressure applied to the hydraulic cylinder. Instead, the setpoint position itself is changed, so that a controlled setpoint quantity, or setpoint position, is applied to a drive control, and in response the drive control in turn carries out control, or preferably closed-loop control, of the control variables of the drive as a function of the applied controlled setpoint position. Preferably, a dual control loop comprising two series-connected open-loop control systems or, in particular, closed-loop control systems, is used.

In a further preferred embodiment, as the deviation, a force control deviation between the measured force and the setpoint force is transformed into a setpoint control variable transformable for position control of the controller of the at least one drive.

In other words, a force control deviation is determined and the setpoint position control variable determined therefrom, which is used for controlling the electromotive drive.

In a further preferred embodiment, a spindle pitch of the drive and/or machine-specific modulus of elasticity are additionally transformed to the setpoint position control variable usable for the position controller.

Further quantities may also be considered, which depend on prevailing temperatures or variable or model-specific geometric and structural or material-dependent quantities, in particular of the press and in its environment. In particular, the machine-specific modulus of elasticity can relate to individual or all components in the force flow between the side of the punch facing the compressible material and the drive or frame elements supporting the drive. Different moduli of elasticity may also be provided for different axes or force flows.

According to a preferred embodiment, the at least one punch is adjusted as part of a floating axis, which means, in particular, an axis which floats, which yields in a controlled manner or which is readjusted.

According to a particularly preferred embodiment, a ceramic and/or metal powder press for pressing a compressible material is provided, comprising at least one electromotive drive, which adjusts at least one punch along a pressing direction, one controller, which is configured to control the drive in such a manner that the drive moves the punch along a setpoint positioning path to each momentary setpoint position of the punch, and the drive readjusts if it deviates from the setpoint positioning path, wherein at least one force-measuring device is arranged in the press for measuring a pressing force acting on the compressible material, the punch or its supporting components, and wherein the measured force is at least one control variable for the controller for readjustment.

The controller can be an independent component or can be a controller entirely or partially integrated in each drive, or its motor, such as in a servo drive.

The drive or drives and the force-measuring devices can be associated with one or more punches or axes, arranged on a side of the die opening opposite the main pressing force. A main pressing force can also be applied by means of an electromotive drive or, optionally, by means of a mechanical, pneumatic or hydraulic drive. The main pressing force is exerted, in particular, by means of one or more punches, which are arranged on the side of the compressible material opposite the thus controlled punch and act on the compressible material. However, a punch, which alone or together with other punches is entirely or partially subject to the main pressing force, can also be controlled in this manner, in particular if a plurality of punches, which are adjustable relative to each other by means of electromotive drives, are arranged on the side of the main pressing force. This also requires that in the case of an electromotive main pressing force, the axis transmitting the force is also configured with servo-motive means and with a spindle drive and thus controllable in a floating manner.

One embodiment of the press provides that the punch is part of a floating axis.

A further embodiment of the press provides that the drive moves a punch relative to at least one punch arranged laterally thereto at least in the pressing position.

In other words, a plurality of punches is arranged on one side of the die opening, wherein this plurality of punches is adjustable independently of each other along the pressing direction. In particular, in such an arrangement, only one, a plurality or all of the punches may be controllable in such a manner.

According to another embodiment of the press, a single such punch is arranged to be adjustable by two or more drives simultaneously, wherein a correction value, in particular a single correction value, determined from the measured force is applied to the drives.

For example, such a punch is arranged on a so-called plate, acting as a punch carrier, wherein the plate is adjustable within the framework or tool along the pressing direction by means of two or more drives. A control deviation determined from one or more measured force values can be used for determining a common setpoint position control variable for all the drives involved. According to a further development, the drives are also independently controllable, in particular controllable as a function of individually determined measured forces, to prevent tilting of the plate, or the punch carrier, by means of suitable control.

Another preferred embodiment provides such a press, wherein the controller is adapted to control the at least one drive by means of a method as described above. In other words, a press equipped with the above-described components is operated using the method for controlling the setpoint positions of at least one punch as a function of at least one measured force.

Another embodiment provides such a press, or such a method, wherein the drive is configured as a servo-motive drive and/or drives a spindle upstream of the punch.

It is thus provided that punches, adjustable as a function of position, are controllable as a function of measured force values also with the aid of electromotive servo spindle drives, in particular.

According to a further development, a setpoint position path of one servo axis or a plurality of servo axes is calculated as a function of a measured force in such a way, that the tool axis, or its punch in particular, follows the programmed force.

BRIEF DESCRIPTION OF THE DRAWINGS

An exemplary embodiment will be described in the following with reference to the drawings, wherein:

FIG. 1 shows individual components of a ceramic and/or metal powder press and a diagram to illustrate the pressing sequence.

DETAILED DESCRIPTION

As shown in FIG. 1, a ceramic and/or metal powder press 1 comprises a frame 2, in which various further components are accommodated. Some of the further components are fixedly connected to the frame 2, and some are adjustable with respect to the latter and relative to each other, in particular along a pressing direction.

A central component is a die 3, having a die opening, in which one or more punches 4, 5 are inserted, in particular from below. Compressible material 6 is able to be filled into the die opening above the punches 4, 5, in particular. One or more further punches 7 are insertable from above into the die opening filled with the compressible material 6, in order to shape the compressible material 6 to a compact. The compressible material 6 is a metallic and/or ceramic powdery and/or granular material, in particular.

The for example only one top punch 7 is attached at the bottom to a punch carrier 8, in particular in the shape of a plate. The punch carrier 8 and the punch 7 are adjustable in and against the pressing direction by means of an electromotive drive 10, which comprises, in particular, a servo motor and a spindle 9.

A force-measuring device 11 is arranged in the area of the top frame 2 shown in the FIGURE, on which the drive 10 and the punch 7 are mounted or arranged. The force-measuring device 11 can be installed, for example, as a load cell, between two of the components arranged between the frame 2 and the punch 7. The force-measuring device 11 is used to measure a compressive force exerted between these components and/or exerted on the compressible material 6 by means of the punch 7, and to output it as a measured force F3.

A central punch 5, for example, and a punch for surrounding the former in an annular manner, are shown below the die 3, which enable pressing of a contoured compact.

The central second punch 5 is arranged on a punch carrier 12, in particular in the shape of a plate. The punch carrier 12 is adjustable relative to a bottom section of the frame 2, for example, by means of two electromotive drives 15, 16 along the pressing direction. The two drives 15, 16 in turn each comprise a motor and a spindle 13, 14 driven by the latter. In the range extending from the frame 2 to the punch 5, force-measuring devices 24, 25 are arranged to measure a current pressing force acting via the drives 15, 16 and to output corresponding measuring values as the measured forces F21 and F22, respectively.

The central lower, first punch 4 is arranged on a punch carrier 17, in particular in the shape of a plate. The punch carrier 17 is adjustable relative to a lower section of the frame 2 by means of, for example, two electromotive drives 20, 21 along the pressing direction. The two drives 20, 21 in turn each comprise a motor and a spindle 18, 19 driven by the latter. In the range extending from the frame 2 to the punch 4, force-measuring devices 22, 23 are arranged to measure a current pressing force acting via the drives 20, 21 and to output corresponding measuring values as measured forces F11 and F12, respectively.

A controller C serves to control and monitor functions of the press 1. In particular, the controller C also serves to control the drives 10, 15, 16, 20, 21. In the case of servo motors or servo drives having their own control circuits, the controller C provides the servo drives or their control circuits with control signals for the setpoint movement to be adjusted. For this purpose the controller C provides, in particular, setpoint position control variables s3, s11, s12, s21 and s22 as control signals for the drives 10, 15, 16, 20 and 21, respectively. The setpoint position control variables s3, s11, s12, s21 and s22, respectively, can be, for example, continuously applied signals or temporary difference or control values, in particular.

The measured forces F3, F11, F12, F21, F22 are thus supplied to the controller C to be considered during a current pressing method.

To carry out a preferred pressing method the controller C takes a predetermined pressing sequence into consideration. The pressing sequence is based on pressing forces which are to be exerted by the punches 4, 5, 7 during a time sequence of the pressing process on the compressible material 6.

This is shown in a position-time diagram below the illustrated components. Curves are shown above the time sequence t, which show a momentary position a. The momentary position a can be an actual position of a surface of a punch 4, 5, 7 contacting the compressible material. For reasons of easier manageability, basically any other, in particular, a sufficiently precisely measurable or determinable position a along the distance from the punch 4, 5, 7 to its drives 13, 16, 20, 21, 10, can be used, in particular also a position determinable by the drive itself.

For simplification, only one setpoint positioning path as3 of the top punch 7 and the setpoint positioning path as1 of the first, bottom punch 5 are shown. For a press having a greater number of punches above and/or below the die opening, a greater number of such setpoint positioning paths are suitably used. In particular, the number of such setpoint positioning paths will depend on the number of axes or punches 4, 5, 7, which are to be controlled.

The setpoint positioning paths as1, as3 are determined as a function of pressing forces required by each of the punches 4, 5, 7 over the time sequence t.

It is shown, for example, during continuous lowering of the top punch 7 that the first bottom punch 5 is initially moved upwards and then slightly lowered from a predetermined position. In particular, a so-called floating movement is to be executed by the bottom punch 5, wherein it yields when the pressing force acting on the compressible material 6 from above is too great. It can also be provided that the bottom punch 5 moves upwards in a readjusting movement if the pressing force acting on the compressible material 6 from above is too weak.

In the cycle of the pressing method shown, it is assumed that the momentary position a1*m* of the bottom punch 5 temporarily deviates upwards from the momentary setpoint position as1*m* provided at this moment. Based on the measured forces F21, F22 of the corresponding force-measuring devices 24, 25 associated with said bottom punch 5, the controller C determines a control deviation εK(21) if the measured force F21 of one of the force-measuring devices 25 deviates, for example, from a setpoint force Fs for the measured force value of this force-measuring device 25, in particular. Therefore, a control signal, or setpoint position control variable s21, which controls readjustment as a function of the control deviation εK(21), is applied to the associated drive 16.

The control deviation εK(21) and thus the setpoint position control variable s21 are thus force-dependent open- or closed-loop control variables, which depend directly on one or also on a plurality, as the case may be, of the measured forces F21.

As the setpoint positioning paths as1, as3 are determined, and also as the setpoint position control variables s3, s11, s12, s21, s22 are determined for the quantities influencing each momentary position a of the corresponding punches 4, 5, 7, preferably also further quantities influencing the pressing process, such as a machine-specific modulus of elasticity E, a spindle pitch and also momentary positions of further punches 4, 5, 7, as the case may be, are also taken into consideration.

During the execution of a pressing method each control deviation εK(21) and/or the momentary setpoint position control variables s3, s11, s12, s21, s22 can be determined in various ways. Basically, a table look-up or a calculation are possible.

In the case of a table look-up, in a table comprising setpoint positions to be reached over time as a function of setpoint forces, the knowledge of a person skilled in the art or a person operating the plant, on a stiffness of the structure, contours and material properties of the compact could also be considered.

Since it is very cumbersome to model all components in the force flow of each of the axes, to obtain the best possible model as a basis for determining correct data for the table, calculation is preferred. In particular, a simplified model can be the basis of calculation. The deviations of the real object from the model are considered in the calculation via the setpoint-actual force difference.

To this end, in the controller C governing the servo controllers, in particular, a setpoint path is calculated using the force, according to the controller clock. If the setpoint force is set in relation to the actual force in operation, this will result in the control deviation EK of the measured force under consideration. This control deviation, together with the spindle pitch and a machine-specific modulus of elasticity is converted to a setpoint position controllable by the position controller of the servo axis, or the drive. If the tool axis or its drive control now follows the calculated path, the provided force profile will automatically be realized on the axis.

LIST OF REFERENCE NUMERALS

1 ceramic and/or metal powder press
2 frame
3 die
4 punch
5 punch
6 compressive material
7 punch
8 punch carrier, in particular in the shape of a plate
9 spindle
10 electromotive drive
11 force-measuring device
12 punch carrier, in particular in the shape of a plate
13 spindle
14 spindle
15 electromotive drive
16 electromotive drive
17 punch carrier, in particular in the shape of a plate
18 spindle
19 spindle
20 electromotive drive
21 electromotive drive
22 force-measuring device
23 force-measuring device
24 force-measuring device
25 force-measuring device
a position along pressing direction
as3 setpoint positioning path of third, top punch
a1*m* momentary position of first, bottom punch
as1 setpoint positioning path of first, bottom punch
as1*m* momentary setpoint position of first, bottom punch
C controller
E machine-specific modulus of elasticity
εK(21) control deviation
F3 measured force as measured quantity
F11 measured force as measured quantity
F12 measured force as measured quantity
F21 measured force as measured quantity
F22 measured force as measured quantity
Fs setpoint force
s3 setpoint position control variable
s11 setpoint position control variable
s12 setpoint position control variable
s21 setpoint position control variable
s22 setpoint position control variable
t time sequence of a pressing method

What is claimed is:

1. A method of controlling a ceramic and/or metal powder press for pressing a compressible material, the ceramic and/or metal powder press including a drive that adjusts a punch supported by one or more supporting components along a pressing direction, the method comprising:

moving, with the drive, the punch along a predetermined position path;

measuring a force acting on the compressible material, the punch, or the one or more supporting components of the punch;

determining a deviation between a position of the punch at a first time and a position of the predetermined position path corresponding to the first time based on a difference between the measured force at the first time and a setpoint force corresponding to the first time;

determining a setpoint control variable for position control of a controller of the drive based on the difference between the measured force and the setpoint force corresponding to the first time;

readjusting the position of the punch with the drive based on the determined setpoint control variable.

2. The method according to claim 1, wherein the readjusting is carried out with respect to the predetermined position path as a function of the measured force.

3. The method according to claim 2, wherein the predetermined position path is predefined as a function of the setpoint force.

4. The method according to claim 1, wherein predetermined positions of the punch are calculated and/or controlled as a function of the measured force.

5. The method according to claim 1, wherein the predetermined position path is calculated as a function of the measured force.

6. The method according to claim 5, wherein the predetermined position path comprises a predetermined position path of a servo axis or a plurality of servo axes.

7. The method according to claim 5, wherein the predetermined position path is calculated as a function of the measured force in such a manner that a tool axis or the punch follows the setpoint force.

8. The method according to claim 1, wherein the drive is attached to a spindle, and wherein the method further comprises determining the setpoint control variable based on a spindle pitch of the drive and/or a machine-specific modulus of elasticity of the ceramic and/or metal powder press.

9. The method according to claim 1, wherein the punch is adjusted as part of a floating axis.

10. The method according to claim 1, wherein the drive is configured as a servo-motive drive and/or drives a spindle on a side of the punch that is opposite the compressible material.

11. A ceramic and/or metal powder press for pressing a compressible material, comprising:

a drive, which adjusts a punch along a pressing direction;

at least one force-measuring device, which is arranged for measuring a pressing force acting on the compressible material, the punch, or supporting components of the punch;

a controller, which is adapted to:

move the punch with the drive along a predetermined position path of the punch, determine a deviation between a position of the punch at a first time and a position of the predetermined position path corresponding to the first time based on a difference between the pressing force measured by the at least one force-measuring device at the first time and a setpoint force corresponding to the first time, determine a setpoint control variable for a position control of the drive based on the difference between the measured force and the setpoint force corresponding to the first time, and readjust the punch with the drive based on the determined setpoint control variable.

12. The press according to claim 11, wherein the punch is part of a floating axis.

13. The press according to claim 11, wherein the drive moves the punch relative to at least one other punch arranged laterally thereto at least in a pressing position.

14. The press according to claim 11, wherein the punch is arranged to be adjustable by two or more drives simultaneously, and wherein the setpoint control variable determined from the measured force is applied to the drives.

15. The press according to claim 14, wherein the setpoint control variable comprises a single setpoint control variable.

16. The press according to claim 11, wherein the controller is adapted to control the drive such that the drive is readjusted with respect to the predetermined position path as a function of the measured force, and wherein the predetermined position path is predefined as a function of the setpoint force.

17. The press according to claim 11, wherein the drive is configured as a servo-motive drive and/or drives a spindle on a side of the punch that is opposite the compressible material.

* * * * *